US011693343B2

(12) United States Patent
Handa et al.

(10) Patent No.: US 11,693,343 B2
(45) Date of Patent: Jul. 4, 2023

(54) DEVICE INCLUDING ROTATOR AND BELT, SUCH AS A FIXING DEVICE FOR AN IMAGE FORMING APPARATUS

(71) Applicant: BROTHER KOGYO KABUSHIKI KAISHA, Nagoya (JP)

(72) Inventors: Hiroshi Handa, Inazawa (JP); Mingguang Zhang, Nagoya (JP); Shuhei Fukue, Nagoya (JP); Tokifumi Tanaka, Komaki (JP); Kenji Takeuchi, Nagoya (JP); Hirotaka Imaeda, Komaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 117 days.

(21) Appl. No.: 17/189,373

(22) Filed: Mar. 2, 2021

(65) Prior Publication Data

US 2021/0181663 A1 Jun. 17, 2021

Related U.S. Application Data

(63) Continuation of application No. 16/729,632, filed on Dec. 30, 2019, now Pat. No. 10,948,858.

(30) Foreign Application Priority Data

Mar. 28, 2019 (JP) ..... 2019-062927
Jul. 24, 2019 (JP) ..... 2019-135777

(51) Int. Cl.
*G03G 15/20* (2006.01)
*G03G 15/00* (2006.01)

(52) U.S. Cl.
CPC ..... *G03G 15/2053* (2013.01); *G03G 15/757* (2013.01); *G03G 15/2028* (2013.01)

(58) Field of Classification Search
CPC ..... G03G 15/2053
(Continued)

(56) References Cited

U.S. PATENT DOCUMENTS

2008/0205924 A1* 8/2008 Fujimoto ..... G03G 15/2039 399/70
2010/0247186 A1 9/2010 Tanaka et al.
(Continued)

FOREIGN PATENT DOCUMENTS

JP 2010-230711 A 10/2010
JP 2010-231008 A 10/2010
(Continued)

OTHER PUBLICATIONS

Office Action (Notice of Reasons for Refusal) issued in corresponding Japanese Patent Application No. 2019-135777, dated Mar. 28, 2023.

*Primary Examiner* — Walter L Lindsay, Jr.
*Assistant Examiner* — Philip T Fadul
(74) *Attorney, Agent, or Firm* — Merchant & Gould P.C.

(57) ABSTRACT

A device includes a rotator having a rotation axis, a belt, a nip forming member surrounded by the belt and configured to, with the rotator, pinch the belt to form a nip, an urging member configured to urge one of the rotator and the nip forming member towards the other in a particular direction perpendicular to the rotation axis, an upstream guide and a downstream guide. The upstream guide includes an upstream guide surface configured to guide an inner peripheral surface of the belt. The nip forming member includes a facing surface which faces the rotator. An upstream edge of the facing surface in the moving direction is located at a position farther from the rotation axis, in the particular direction, than a downstream edge of the upstream guide surface.

20 Claims, 7 Drawing Sheets

(58) Field of Classification Search
USPC ..... 399/162
See application file for complete search history.

(56) References Cited

U.S. PATENT DOCUMENTS

| | | | | |
|---|---|---|---|---|
| 2015/0098736 | A1 | 4/2015 | Furukata et al. | |
| 2016/0246227 | A1* | 8/2016 | Ishimori ..... | G03G 15/2032 |
| 2016/0259282 | A1 | 9/2016 | Komatsu et al. | |
| 2017/0261900 | A1 | 9/2017 | Sawada et al. | |
| 2018/0244072 | A1 | 8/2018 | Tanaka et al. | |

FOREIGN PATENT DOCUMENTS

| | | | |
|---|---|---|---|
| JP | 2015-75553 | A | 4/2015 |
| JP | 2016-57528 | A | 4/2016 |
| JP | 2016-161858 | A | 9/2016 |
| JP | 2018-17814 | A | 2/2018 |
| JP | 2018-138937 | A | 9/2018 |

* cited by examiner

DEVICE INCLUDING ROTATOR AND BELT, SUCH AS A FIXING DEVICE FOR AN IMAGE FORMING APPARATUS

CROSS-REFERENCE TO RELATED APPLICATION

This application is a continuation of U.S. patent application Ser. No. 16/729,632, filed Dec. 30, 2019, now U.S. Pat. No. 11,003,128, which claims priority from Japanese Patent Application No. 2019-062927 filed on Mar. 28, 2019, and Japanese Patent Application No. 2019-135777 filed Jul. 24, 2019. The contents the aforementioned applications is incorporated herein by reference in their entirety.

TECHNICAL FIELD

Aspects of the disclosure relate to a fixing device including a rotator and a belt, and an image forming apparatus including the fixing device.

BACKGROUND

A known fixing device includes a belt, a heat roller and a rubber pad that sandwich therebetween the belt, and an upstream guide surface located upstream of the rubber pad in a sheet conveying direction to guide the belt. In a direction where the rubber pad is pressed by the heat roller, a downstream end of the upstream guide surface is spaced from the rotation center of the heat roller further than an upstream end of the rubber pad.

SUMMARY

According to one or more aspects of the disclosure, a device includes a rotator, a belt, a nip forming member, an urging member, an upstream guide, and a downstream guide. The rotator has a rotation axis. The nip forming member is surrounded by the belt and configured to, with the rotator, pinch the belt to form a nip. The urging member is configured to urge one of the rotator and the nip forming member towards the other in a particular direction perpendicular to the rotation axis. The upstream guide includes an upstream guide surface configured to guide an inner peripheral surface of the belt. The upstream guide surface is positioned entirely upstream of the nip in a moving direction of the belt perpendicular to the particular direction and the rotation axis. The upstream guide does not form the nip. The downstream guide includes a downstream guide surface configured to guide the inner peripheral surface of the belt. The downstream guide surface is positioned entirely downstream of the nip in the moving direction. The downstream guide does not form the nip. The nip forming member includes a facing surface which faces the rotator. An upstream edge of the facing surface in the moving direction is located at a position farther from the rotation axis, in the particular direction, than a downstream edge of the upstream guide surface.

DETAILED DESCRIPTION

An illustrative embodiment will be described with reference to the accompany drawings.

Figure 1:
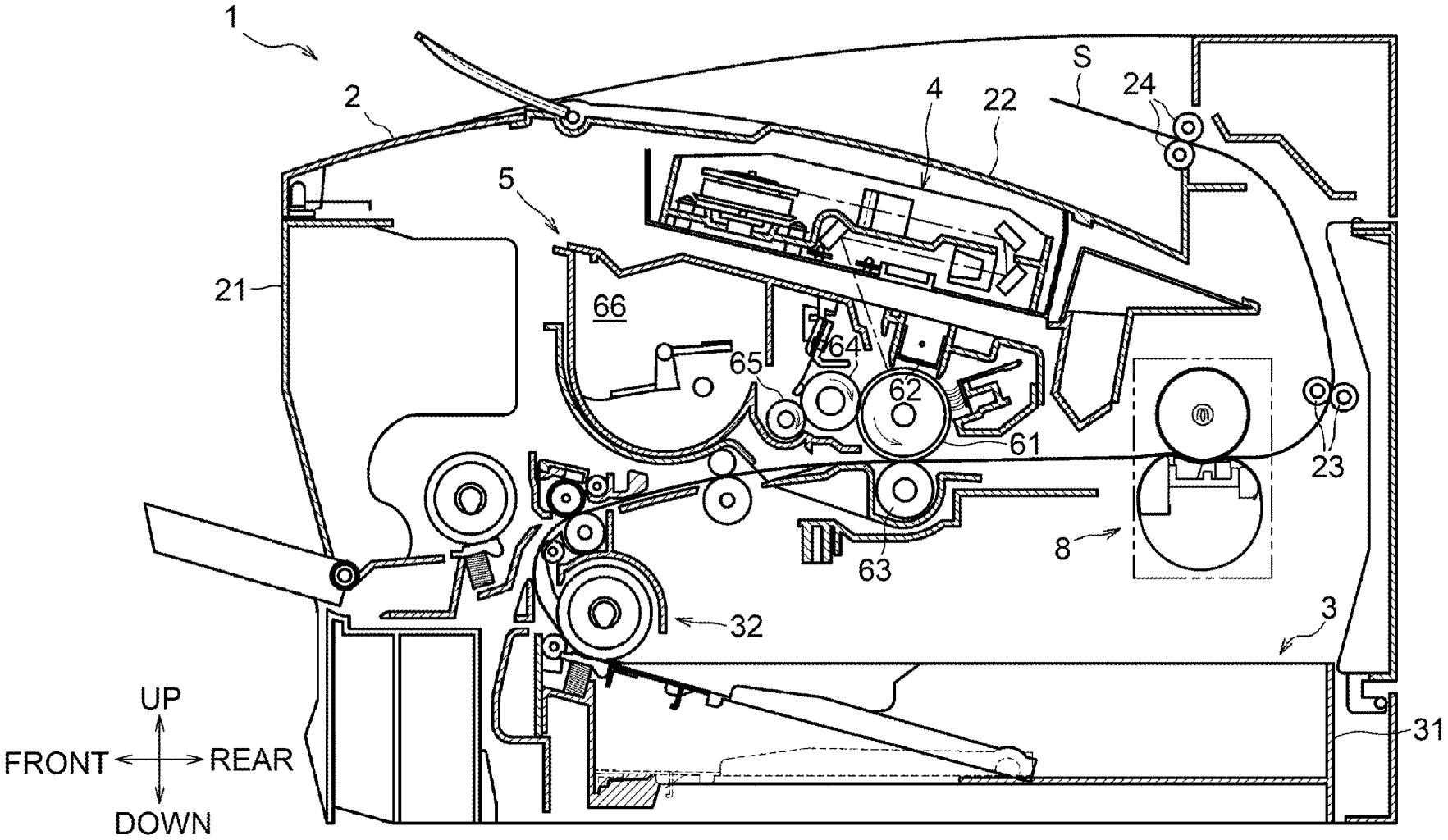
FIG. 1 is a cross sectional view of a laser printer according to an illustrative embodiment of the disclosure.

As illustrated in FIG. 1, an image forming apparatus 1 (e.g., a laser printer) includes a casing 2, a sheet supply unit 3, an exposure device 4, an image forming unit 5, and a fixing device 8.

The sheet supply unit 3 is disposed in a lower portion of the casing 2. The sheet supply unit 3 includes a sheet tray 31 for accommodating sheets S (e.g., sheets of paper), and a sheet supply mechanism 32. The sheet supply mechanism 32 supplies a sheet S from the sheet tray 31 toward the image forming unit 5.

The exposure device 4 is disposed in an upper portion of the casing 2. The exposure device 4 includes a laser emitter, a polygon mirror, lenses, and reflecting mirrors. The exposure device 4 is configured to expose a surface of a photosensitive drum 61 by scanning thereon at high speed a laser beam (indicated by a dot-and-dash line) emitted from the laser emitter based on image data.

The image forming unit 5 is disposed below the exposure device 4. The image forming unit 5 is constituted as a process cartridge. The image forming unit 5 is removable from the casing 2 through an opening formed when a front cover 21 disposed at a front of the casing 2 is open. The image forming unit 5 includes a photosensitive drum 61, a charger 62, a transfer roller 63, a developing roller 64, a supply roller 65, and a developer chamber 66 configured to store therein developer, for example, dry toner.

In the image forming unit 5, the charger 62 uniformly charges the surface of the photosensitive drum 61. Thereafter, the exposure device 4 exposes the surface of the photosensitive drum 61 to a laser beam, and the surface of the photosensitive drum 61 carries an electrostatic latent image corresponding to image data. The supply roller 65 supplies developer in the developer chamber 66 to the developing roller 64.

The developing roller 64 supplies developer to the electrostatic latent image formed on the surface of the photosensitive drum 61. The electrostatic latent image on the surface of the photosensitive drum 61 is thus visually developed as a developer image. Thereafter, when a sheet S supplied from the sheet supply unit 3 passes through between the photosensitive drum 61 and the transfer roller 63, the developer image is transferred from the photosensitive drum 61 onto the sheet S.

The fixing device 8 is disposed at the rear of the image forming unit 5. An overall structure of the fixing device 8 will be described in detail later. The fixing device 8 thermally fixes the developer image transferred onto a sheet S passing through the fixing device 8. The image forming apparatus 1 uses conveying rollers 23 and discharge rollers 24 to discharge the sheet S having the developer image fixed thereto onto a discharge tray 22.

Figure 2:
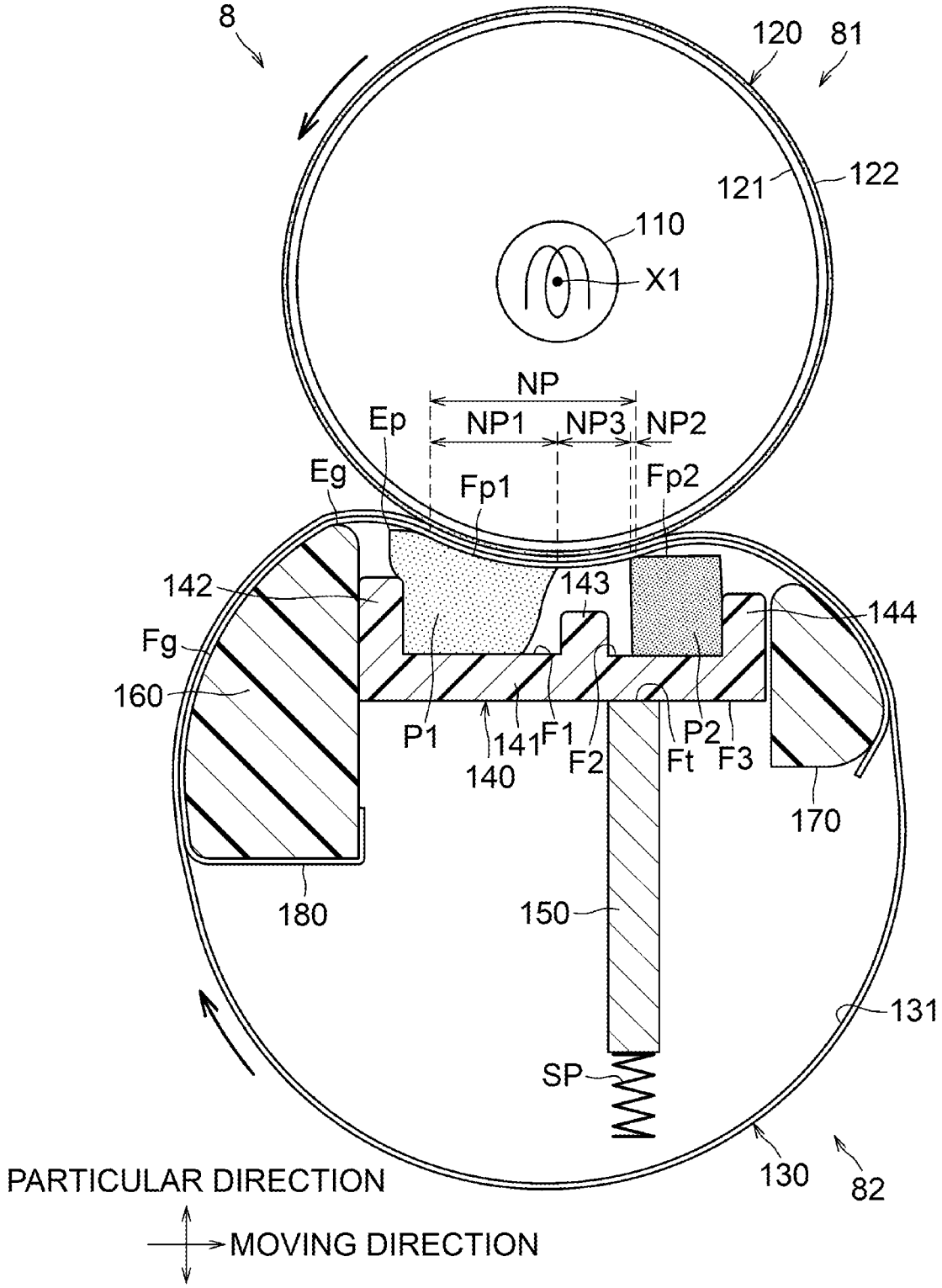
FIG. 2 is a cross sectional view of a fixing device of the image forming apparatus.

As illustrated in FIG. 2, the fixing device 8 includes a heating unit 81, a pressure unit 82, and an urging member SP. The pressure unit 82 is urged toward the heating unit 81 by the urging member SP. In the following description, a direction in which the urging member SP urges the pressure unit 82 toward the heating unit 81 is referred to as "a particular direction". The particular direction is orthogonal to a width direction and a moving direction which will be described later. The heating unit 81 and the pressure unit 82 face to each other in the particular direction.

In this embodiment, the urging member SP is simply illustrated as, but is not limited to, a helical compression spring. The urging member may be a helical tension spring that pulls an end of an arm rotatably supported by a frame of the fixing device 8. In this case, the helical tension spring may urge the pressure unit 82 toward the heating unit 81 via the arm.

The heating unit 81 includes a heater 110 and a rotator 120. The pressure unit 82 includes a belt 130, a nip forming member including an upstream pad P1 and a downstream pad P2, a holder 140, a stay 150, an upstream guide 160, a downstream guide 170, and a sliding sheet 180. In the following description, a width direction of the belt 130 is referred to as just "a width direction". The width direction extends in an axial direction of the rotator 120. The width direction is orthogonal to the particular direction.

In this embodiment, the holder 140, the upstream guide 160, and the downstream guide 170 are assembled to the stay 150. Instead of using the stay 150, side guides (not illustrated) may support both end portions, in the width direction, of the holder 140, the upstream guide 160, and the downstream guide 170.

The heater 110 is a halogen lamp and, when turned on, produces light for radiant heat to heat the rotator 120. The heater 110 is disposed within an interior space of the rotator 120 along a rotation axis of the rotator 120.

The rotator 120 is a cylindrical roller extending in the width direction to receive heat from the heater 110. The rotator 120 includes a metal-made tube 121 and an elastic layer 122 covering an outer peripheral surface of the tube 121. The elastic layer 122 is made of rubber such as silicone rubber. The rotator 120 has an outside diameter greater at its both ends in the width direction than its central portion. In other words, the rotator 120 has a concave shape with its outside diameter gradually greater from its central portion toward its both ends. The rotator may have a different shape. For example, the rotator may be cylindrical with a uniform outside diameter in the width direction. Alternatively, the rotator may have a crown shape having its outside diameter smaller from its central portion toward its both ends in the width direction.

The rotator 120 is rotatably supported by the frame of the fixing device 8. The rotator 120 receives a driving force from a motor disposed in the casing 2 to rotate counterclockwise in FIG. 2.

The belt 130 is a flexible, long tubular member. The belt 130 has a base made of, for example, metal and resin, and a releasable layer covering an outer peripheral surface of the base. The belt 130 is in frictional contact with the rotator 120 or a sheet S and rotates clockwise in FIG. 2 with the rotation of the rotator 120. A lubricant, such as grease, is applied to an inner peripheral surface 131 of the belt 130. The upstream pad P1, the downstream pad P2, the holder 140, the stay 150, the upstream guide 160, the downstream guide 170, and the sliding sheet 180 are disposed within an interior space of the belt 130.

The nip forming member (i.e. the upstream P1 and the downstream pad P2) is surrounded by the belt 130 and together with the rotator 120, pinch the belt 130 to form a nip NP. In the illustrated examples, the nip NP has an upstream nip NP1 and a downstream nip NP2. More specifically, the upstream pad P1 is box-shaped and long in the width direction. The upstream pad P1 is made of rubber, such as silicone rubber. The upstream pad P1 and the rotator 120 pinch the belt 130 therebetween, forming the upstream nip NP1.

In the following description, a moving direction of the belt 130 at the upstream nip NP1 and the nip NP is referred to as just "a moving direction". The moving direction is a direction where the belt 130 moves along an outer peripheral surface of the rotator 120. This direction is, however, along a direction substantially orthogonal to the particular direction and the width direction, and thus illustrated as being orthogonal to the particular direction and the width direction. The moving direction is substantially the same as a direction directed from an entrance to the nip NP toward an exit therefrom.

The downstream pad P2 is box-shaped and long in the width direction. The downstream pad P2 is made of rubber, such as silicone rubber. The downstream pad P2 and the rotator 120 pinch the belt 130 therebetween, forming a downstream nip NP2.

The downstream pad P2 is disposed downstream from the upstream pad P1 in the moving direction. The downstream pad P2 is spaced from the upstream pad P1 in the moving direction.

This structure provides, between the upstream nip NP1 and the downstream nip NP2, a middle nip NP3 where no pressure from the pressure unit 82 directly acts. At the middle nip NP3, the belt 130 still contacts the rotator 120 but hardly receives pressure because there is nothing to pinch the belt 130 with the rotator 120. Thus, the sheet S is heated by the rotator 120 under almost no pressure while passing the middle nip NP3. In this embodiment, the nip NP refers to a range from the upstream end of the upstream nip NP1 to the downstream end of the downstream nip NP2, that is, the entire range where the outer peripheral surface of the belt 130 and the rotator 120 contact each other. In other words, the nip NP includes a portion not subjected to pressure from the upstream pad P1 and the downstream pad P2.

The upstream pad P1 has a higher hardness than the elastic layer 122 of the rotator 120. The downstream pad P2 has a higher hardness than the upstream pad P1.

The above hardness refers to a durometer hardness specified in ISO7619-1. The durometer hardness is a value that may be obtained from an amount of the penetration of a pin into a specimen under specified conditions. For example, when the durometer hardness of the elastic layer 122 is 5, that of the upstream pad P1 is preferably 6 to 10, and that of the downstream pad P2 is preferably 70 to 90.

The hardness of silicone rubber may be adjusted by changing the ratio of an additive (e.g., a silica filler and a carbon filler) to be added at the time of manufacture. Specifically, the hardness of silicone rubber increases with a higher ratio of an additive. The hardness decreases with the addition of silicone-based oil. As a rubber processing method, injection molding and extrusion may be adopted. Generally, injection molding is suitable for low hardness rubber and extrusion is suitable for high hardness rubber.

The upstream guide 160 has an upstream guide surface Fg to guide the inner peripheral surface 131 of the belt 130 at a position upstream from the nip NP in a rotation direction of the belt 130, that is, in the moving direction at the nip NP.

More specifically, the upstream guide surface Fg guides the inner peripheral surface 131 of the belt 130 via the sliding sheet 180. The upstream guide 160 is spaced from the upstream pad P1 in the moving direction, and as such, the upstream guide 160 is entirely upstream of the upstream pad P1 and does not form part of the nip NP. The upstream guide 160 is made of a heat-resistant resin.

The downstream guide 170 has a downstream guide surface Fd to guide the inner peripheral surface 131 of the belt 130 at a position downstream from the nip NP in the rotation direction of the belt 130, that is, in the moving direction. More specifically, the downstream guide surface Fd guides the inner peripheral surface 131 of the belt 130 via the sliding sheet 180. The downstream guide 170 is spaced from the downstream pad P2 in the moving direction, and as such, the downstream guide 170 is entirely downstream of the downstream pad P2 and does not form part of the nip NP. The downstream guide 170 is spaced in the particular direction from a rotation center X1 of the rotator 120 further than the downstream pad P2. More specifically, an upstream end Ed of the downstream guide surface Fd in the moving direction is located at a position farther from the rotation center X1 of the rotator 120, in the particular direction, than a facing surface Fp2 of the downstream pad P2. The downstream guide 170 is made of a heat-resistant resin.

The sliding sheet 180 is rectangular and reduces frictional resistance between each pad P1, P2 and the belt 130. The sliding sheet 180 is pinched at the nip between the inner peripheral surface 131 of the belt 130 and each pad P1, P2. The sliding sheet 180 has one end fixed to an inner wall surface of the upstream guide 160. The inner wall surface of the upstream guide 160 is opposite to the guide surface Fg and spaced from the inner peripheral surface 131 of the belt 130 further than the guide surface Fg. The sliding sheet 180 is located covering the guide surface Fg of the upstream guide 160, with its other end located between the downstream guide 170 and the inner peripheral surface 131 of the belt 130.

The embodiment shows but is not limited to that the other end of the sliding sheet 180 is a free end. The other end of the sliding sheet 180 may be fixed to the downstream guide 170. The sliding sheet 180 may be made of any material. In this embodiment, a polyimide-containing resin sheet is used.

The holder 140 holds the upstream pad P1 and the downstream pad P2. The holder 140 is made of a heat-resistant resin. The holder 140 is long in the width direction. The holder 140 includes a support wall 141, an upstream wall 142, a middle wall 143, and a downstream wall 144.

The support wall 141 has an upstream support surface F1 for supporting the upstream pad P1 and a downstream support surface F2 for supporting the downstream pad P2. When viewed in cross section orthogonal to the width direction, the upstream support surface F1 and the downstream support surface F2 are orthogonal to the particular direction. The upstream support surface F1 and the downstream support surface F2 are at the same positions in the particular direction.

The upstream wall 142, the middle wall 143, and the downstream wall 144 extend from the support wall 141 toward the rotator 120. The upstream wall 142 is disposed at an upstream end of the support wall 141.

The downstream wall 144 is disposed at a downstream end of the support wall 141. The middle wall 143 is disposed between and spaced from the upstream wall 142 and the downstream wall 144.

The upstream support surface F1 is located between the upstream wall 142 and the middle wall 143. The downstream support surface F2 is located between the middle wall 143 and the downstream wall 144.

The upstream pad P1 is located in contact with the upstream wall 142 and spaced from the middle wall 143. The downstream pad P2 is located in contact with the downstream wall 144 and spaced from the middle wall 143.

Figure 4:
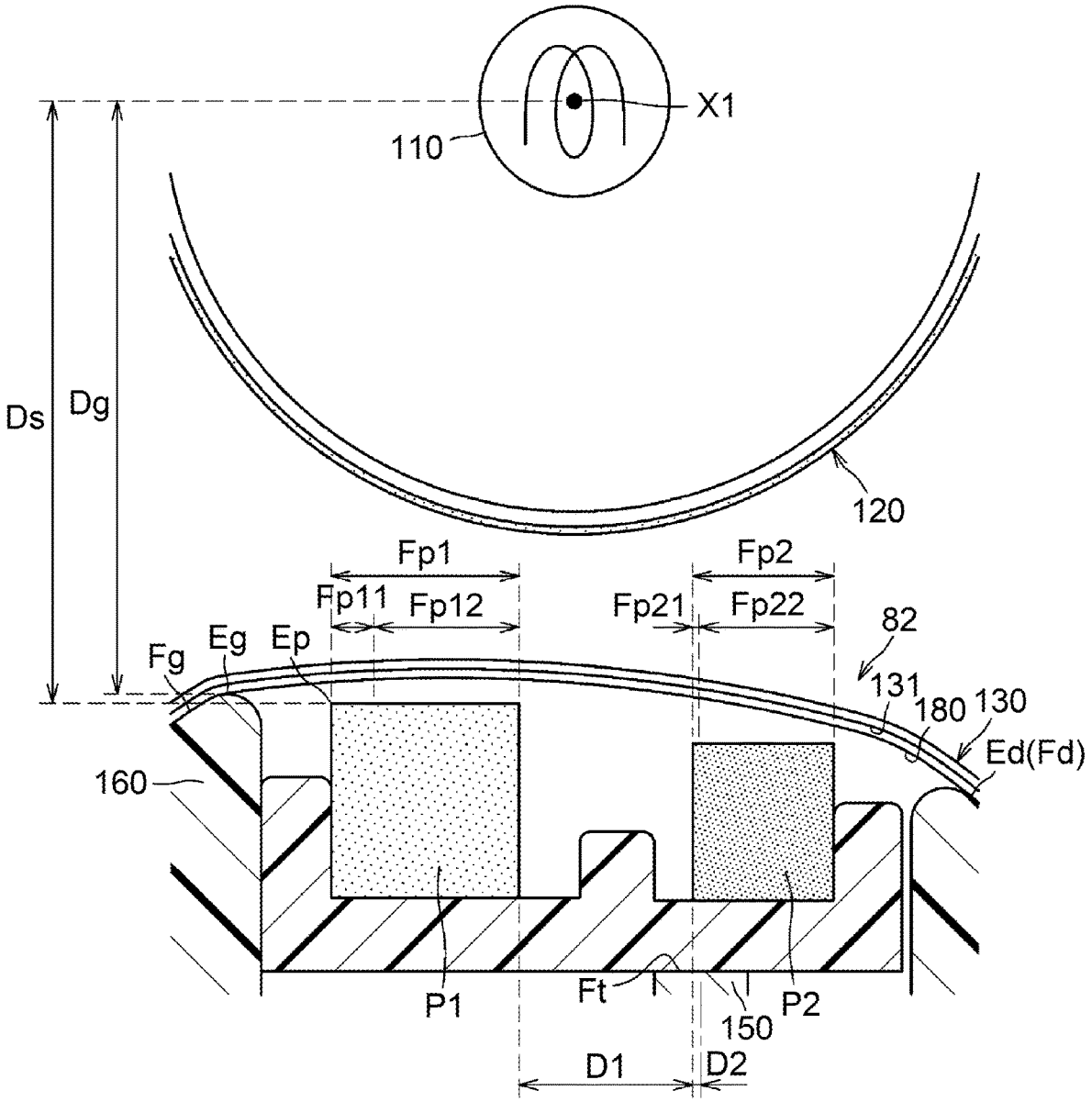
FIG. 4 is an enlarged cross sectional view of the pressure unit at a nip release position.

The stay 150 transmits a force from the urging member SP to the holder 140. The stay 150 is made of metal. The stay 150 is long in the width direction. The stay 150 has a contact surface Ft that contacts a surface F3 of the support wall 141 opposite to each support surface F1, F2. The stay 150 is disposed to the downstream pad P2 in the moving direction. As illustrated in FIG. 4, a distance D2 is smaller than a distance D1 in the moving direction. The distance D2 is a distance from a center of the contact surface Ft of the stay in the moving direction to an upstream end of the downstream pad P2 in the moving direction. The distance D1 is a distance from the center of the contact surface Ft to a downstream end of the upstream pad P1 in the moving direction. The stay 150 is disposed such that the stay 150 projected in the particular direction overlaps the downstream pad P2.

Figure 5:
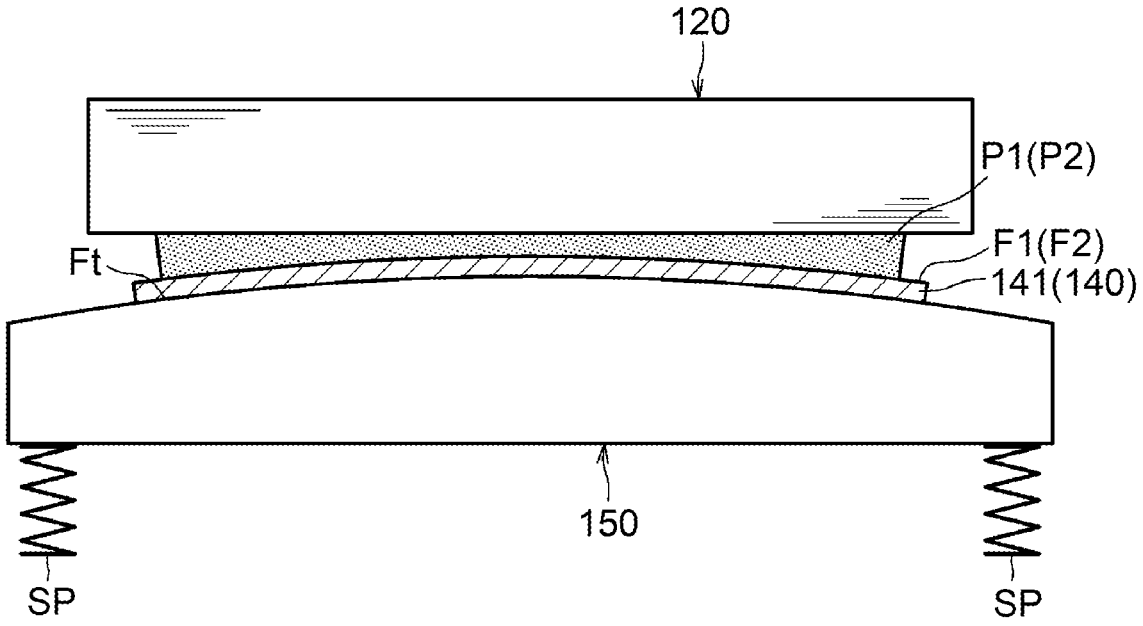
FIG. 5 illustrates that a stay and a support surface of a holder are convex.

As illustrated in FIG. 5, the contact surface Ft of the stay 150 is convex toward the rotator 120 when viewed in the moving direction, with its center in the width direction protruding further than its ends. One urging member SP is disposed at each of both ends of the stay 150 in the width direction.

While each urging member SP urges a corresponding end of the stay 150 toward the rotator 120, a central portion of the stay 150 in the width direction receives a reaction force from the rotator 120 and thus becomes deformed in a direction away from the rotator 120. In this case, if the contact surface Ft of the stay 150 is flat, the nip pressure at the central portion of the stay 150 in the width direction may become too low. In this embodiment, however, the contact surface Ft is convex as described above. This prevents the nip pressure at the central portion of the stay 150 from becoming too low.

While each urging member SP urges a corresponding end of the stay 150 toward the rotator 120, the support wall 141 of the holder 140 is deformed following the shape of the contact surface Ft of the stay 150. In this state, when viewed in the moving direction, the center of the upstream support surface F1 in the width direction is located closer to the rotator 120 than the ends of the upstream support surface F1 in the width direction. Similarly, when viewed in the moving direction, the center of the downstream support surface F2 in the width direction is located closer to the rotator 120 than the ends of the downstream support surface F2 in the width direction.

Figure 3:
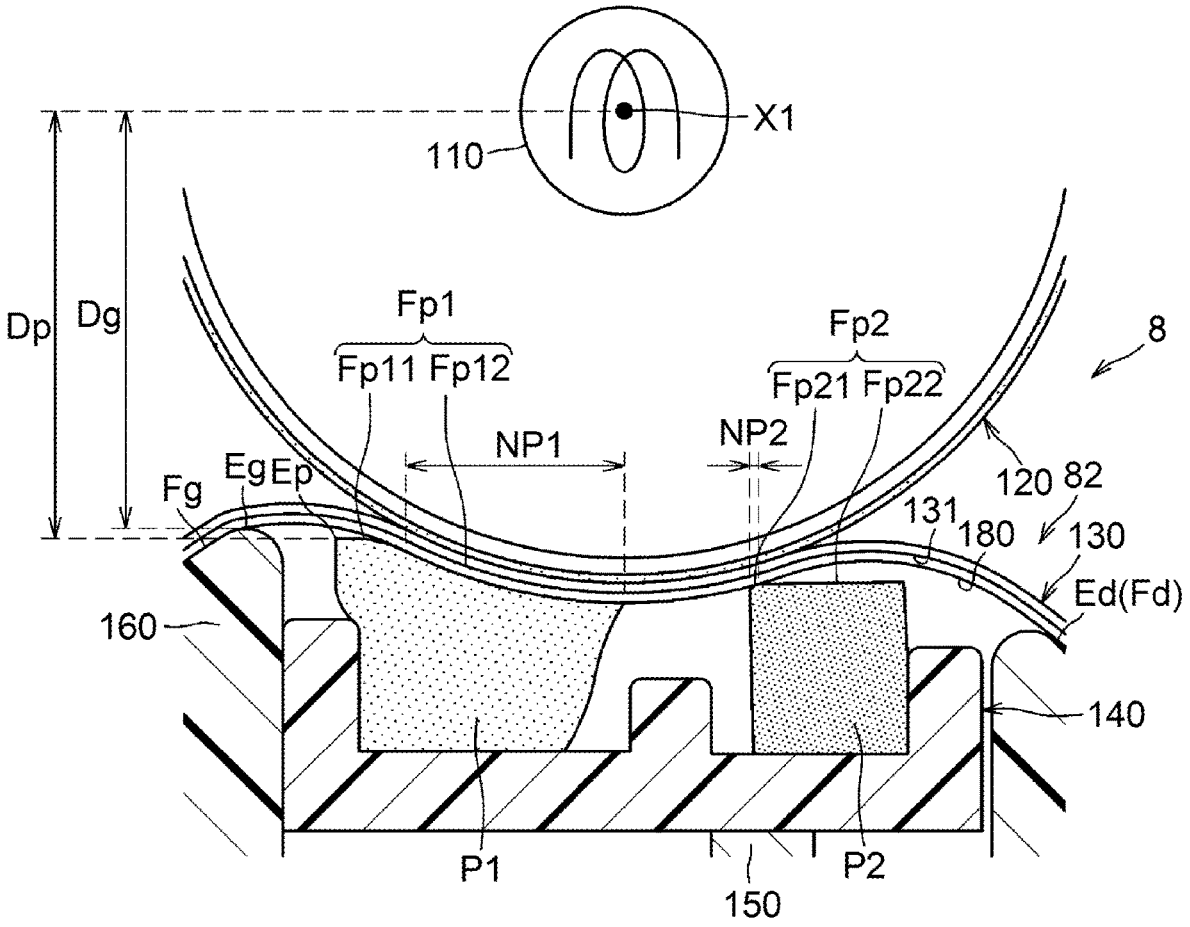
FIG. 3 is an enlarged cross sectional view of a pressure unit of the fixing device at a pressed position.

As illustrated in FIGS. 3 and 4, the upstream pad P1 has a facing surface Fp1 that faces the rotator 120. The facing surface Fp1 faces the rotator 120 via the sliding sheet 180 and the inner peripheral surface 131 of the belt 130.

An upstream end Ep of the facing surface Fp1 in the moving direction is located at a position farther from the rotation center X1 of the rotator 120, in the particular direction, than a downstream end Eg of the guide surface Fg of the upstream guide 160. In other words, when the pressure unit 82 is at a pressed position illustrated in FIG. 3, a distance Dp is greater than a distance Dg1. When the pressure unit 82 is at a nip release position illustrated in FIG. 4, a distance Ds is greater than the distance Dg2. The distance Dp is a distance from the rotation center X1 to the upstream end Ep of the upstream pad P1 in the particular direction when the pressure unit 82 is at the pressed position illustrated in FIG. 3. The distance Dg1 is a distance from the rotation center X1 to the downstream end Eg of the upstream guide 160 in the particular direction when the pressure unit 82 is at the pressed position illustrated in FIG. 3. The distance Ds is a distance from the rotation center X1 to the upstream end Ep of the upstream pad P1 in the particular direction when the pressure unit 82 is at the nip release position illustrated in FIG. 4. The distance Dg2 is a distance from the rotation center X1 to the downstream end Eg of the upstream guide 160 when the pressure unit 82 is at the nip release position illustrated in FIG. 4.

The facing surface Fp1 has an upstream portion Fp11 and a downstream portion Fp12.

The upstream portion Fp11 includes the upstream end Ep of the facing surface Fp1. The upstream portion Fp11 is spaced from the sliding sheet 180. In other words, the upstream portion Fp11 and the rotator 120 do not pinch the belt 130 and the sliding sheet 180 therebetween.

The downstream portion Fp12 is located downstream of the upstream portion Fp11 in the moving direction. The downstream portion Fp12 and the rotator 120 pinch the belt 130 and the sliding sheet 180 therebetween, thus forming the upstream nip NP1.

The upper surface of the upstream wall 142 of the holder 140 is spaced in the particular direction from the rotation center X1 further than the downstream end Eg of the upstream guide 160 and the facing surface Fp1 of the upstream pad P1. At least when each pad P1, P2 is under no pressure (FIG. 4), the upstream guide 160 is spaced from the upstream pad P1 in the moving direction by a distance greater than or equal to the dimension of the upstream wall 142 in the moving direction.

The downstream pad P2 has the facing surface Fp2 located to the rotator 120 and facing the inner peripheral surface 131 of the belt 130. The facing surface Fp2 faces the rotator 120 via the sliding sheet 180 and the inner peripheral surface 131 of the belt 130.

The facing surface Fp2 has an upstream portion Fp21 and a downstream portion Fp22. The upstream portion Fp21 includes an upstream end of the facing surface Fp2. The upstream portion Fp21 and the rotator 120 pinch the belt 130 and the sliding sheet 180 therebetween, thus forming the downstream nip NP2.

The downstream portion Fp22 is located downstream of the upstream portion Fp21 in the moving direction. The downstream portion Fp22 is spaced from the sliding sheet 180. In other words, the downstream portion Fp22 and the rotator 120 do not pinch the belt 130 and the sliding sheet 180 therebetween.

The upper surface of the downstream wall 144 of the holder 140 is spaced in the particular direction from the rotation center X1 further than the upstream end Ed of the downstream guide surface Fd of the downstream guide 170 in the moving direction and the facing surface Fp2 of the downstream pad P2. At least when each pad P1, P2 is under no pressure (FIG. 4), the downstream guide 170 is spaced from the downstream pad P2 in the moving direction by a distance greater than or equal to the dimension of the downstream wall 144 in the moving direction.

As illustrated in FIG. 4, when the rotator 120 is spaced from the belt 130 or when each pad P1, P2 is under no pressure, the upstream pad P1 has a dimension greater in the particular direction than that of the downstream pad P2. In other words, when the rotator 120 is spaced from the belt 130, the downstream portion Fp12 of the upstream pad P1 is located closer to the rotation center X1 of the rotator 120 than the upstream portion Fp21 of the downstream pad P2 in the particular direction.

The pressure unit 82 is movable between the pressed position illustrated in FIG. 3 and the nip release position illustrated in FIG. 4 by cams and urging members SP. The cams are each located at a position to press a corresponding end of the stay 150 in the width direction against the urging force of the urging member SP.

Technical advantages of the fixing device 8 according to the illustrative embodiment will now be described.

When the pressure unit 82 moves from the nip release position illustrated in FIG. 4 to the pressed position illustrated in FIG. 3, the downstream portion Fp12 of the upstream pad P1 is pressed more than the upstream portion Fp21 of the downstream pad P2. The downstream portion Fp12 of the upstream pad P1 and the rotator 120 thus form the upstream nip NP1 therebetween with stability.

As illustrated in FIG. 2, when the fixing device 8 is driven, the rotator 120 rotates counterclockwise and the belt 130 rotated clockwise. The upstream end Ep of the upstream pad P1 is spaced from the rotation center X1 further than the downstream end Eg of the guide surface Fg of the upstream guide 160, and the belt 130 and the sliding sheet 180 are not pinched between the upstream end Ep of the upstream pad P1 and the rotator 120. Thus, the belt 130 does not press the upstream end Ep of the upstream pad P1 via the sliding sheet 180. This prevents unintended deformation of the upstream pad P1.

From the above description, the illustrative embodiment may have the following advantages.

The upstream pad P1 is prevented from being deformed into an unintended shape. This prevents fluctuations of the width (the dimension in the moving direction) of the nip NP. The upstream nip NP1 is formed without the use of the upstream portion Fp11 of the upstream pad P1, thus improving durability of the upstream pad P1, unlike, for example, a structure forming an upstream nip with the use of the entire upstream pad. The downstream nip NP2 is formed with the rubber-made downstream pad P2. Unlike a pad made of a hard material, for example, resin, the rubber-made downstream pad P2 may provide correct nip pressure for the downstream nip NP2 without the need to be shaped accurately.

When the rotator 120 and each pad P1, P2 are pressed in contact with each other, the downstream portion Fp12 of the upstream pad P1 can be pressed before the upstream portion Fp21 of the downstream pad P2 is pressed, thus forming the upstream nip NP1 with stability.

The upstream pad P1 is spaced from the downstream pad P2 in the moving direction. This allows for widening of the width of the nip NP without the need to use a wider pad. The pads P1, P2 are insusceptible to each other's heat.

The upstream guide 160 is spaced from the upstream pad P1 in the moving direction. This reduces heat transmission from the upstream pad P1 to the upstream guide 160.

The downstream guide 170 is spaced from the downstream pad P2 in the moving direction. This reduces heat transmission from the downstream pad P2 to the downstream guide 170.

The downstream guide 170 is spaced in the particular direction from the rotation center X1 of the rotator 120 further than the downstream pad P2. This reduces the belt 130 having passed the downstream pad P2 from being caught and worn by the downstream guide 170.

When viewed in cross section orthogonal to the width direction, the upstream support surface F1 and the downstream support surface F2 are orthogonal to the particular direction. This structure provides a great angle between a tangent to the rotator 120 at the downstream end of the downstream nip NP2 and the facing surface Fp2 of the downstream pad P2, when compared to a structure where, for example, the support surface for the downstream pad is inclined relative to the support surface for the upstream pad and each pad is entirely pressed in contact with the rotator. A sheet S having passed the downstream nip NP2 can thus separate from the rotator 120 easily.

When viewed in the moving direction, the upstream support surface F1 and the downstream support surface F2 each have a central portion in the width direction, which is convex toward the rotator 120. This convex shape prevents the nip pressure at the central portion from becoming low, unlike a structure that each support surface F1, F2 may be flat.

The stay 150 that receives a force from the urging member SP is disposed to the downstream pad P2, thus maintaining the nip pressure of the downstream nip NP2 appropriately.

While the disclosure has been described in detail with reference to the specific embodiment thereof, various changes, arrangements and modifications may be applied therein as will be described below. In the following description, elements similar to or identical with those illustrated in the above embodiment are designated by similar numerals, and thus the description thereof can be omitted for the sake of brevity.

The upstream guide is shaped as illustrated in the above embodiment, but may have any other shape. In an alternative embodiment illustrated in FIGS. 6A and 7, an upstream guide 260 includes an outer peripheral wall 261 and ribs 262. The outer peripheral wall 261 has a guide surface Fg similar to that of the above embodiment. The outer peripheral wall 261 has an inner peripheral surface Fb opposite to the guide surface Fg.

Figure 6A:
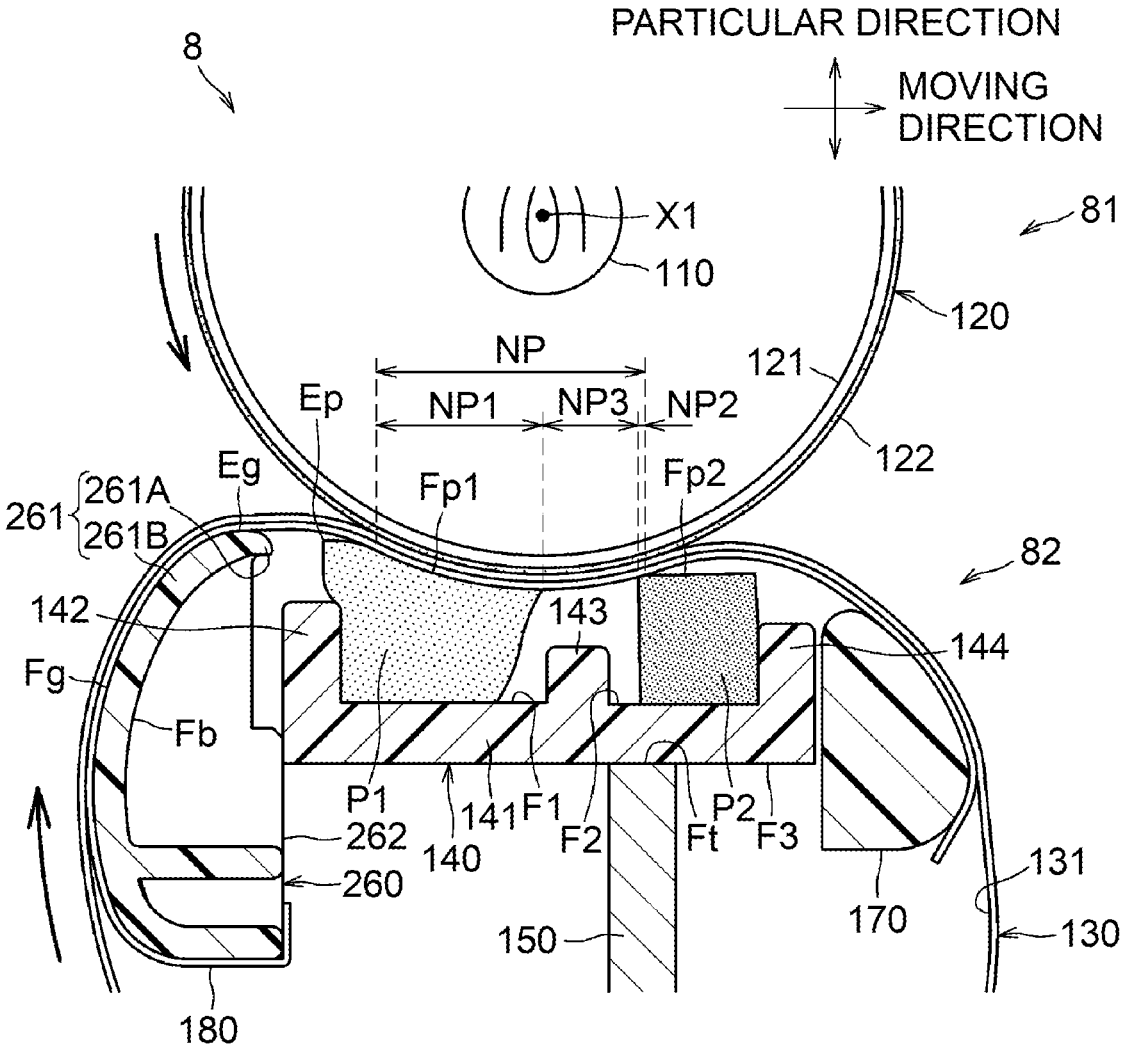
FIG. 6A is a cross sectional view of an upstream guide according to an alternative embodiment of the disclosure.
Figure 6B:
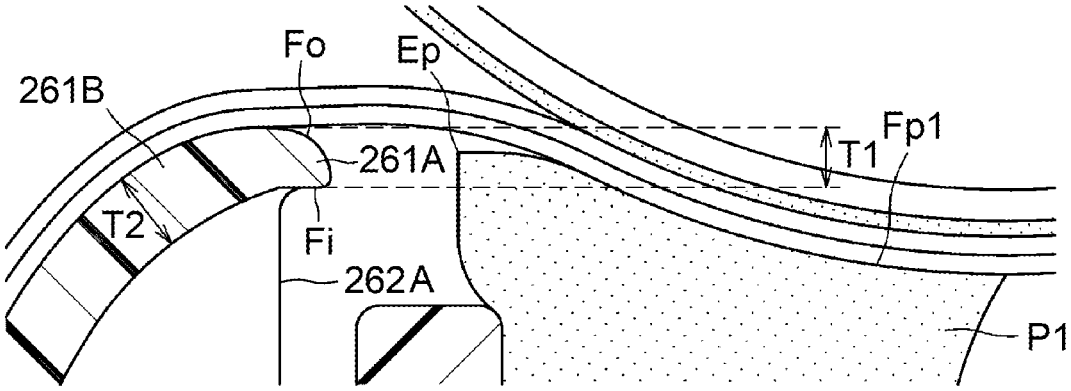
FIG. 6B is an enlarged cross sectional view of the upstream guide.
Figure 7:
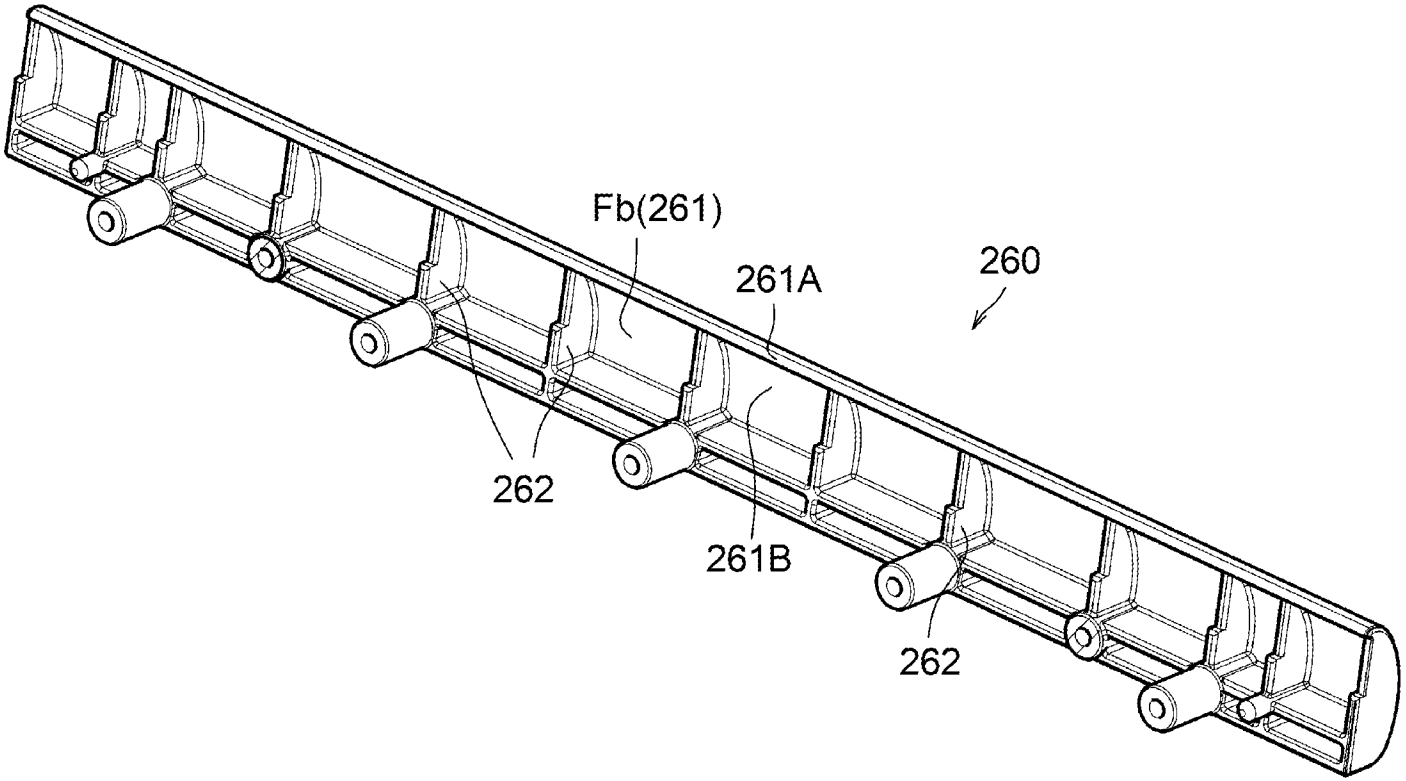
FIG. 7 is a perspective view of the upstream guide illustrated in FIGS. 6A and 6B.

As illustrated in FIG. 7, the ribs 262 protrude from the inner peripheral surface Fb of the outer peripheral wall 261. The ribs 262 are spaced from one another in the width direction. As illustrated in FIGS. 6A and 6B, each rib 262 has an upper portion 262A and a lower portion 262B. The upper portion 262A faces the pad P1 in the moving direction. The upper portion 262A connects the outer peripheral wall 261 and the lower portion 262B. The lower portion 262B faces the support wall 141 and the stay 150 in the moving direction. The lower portion 262B is located at a position farther from the rotation center X1 of the rotator 120, in the particular direction, than the upper portion 262A.

Returning to FIG. 6A, the outer peripheral wall 261 includes a downstream end portion 261A in the moving direction and a base portion 261B extending from an upstream end of a rib 262 to a downstream end of the rib 262 in the rotation direction of the belt 130. The downstream end portion 261A is located further downstream than the upper portion 262A of the rib 262 in the moving direction.

As illustrated in FIG. 6B, the downstream end portion 261A has a thickness T1. The thickness T1 may be smaller than or equal to a thickness T2 of the base portion 261B. In this alternative embodiment, the thickness T1 is smaller than the thickness T2 of the base portion 261B. The downstream end portion 261A tapers downstream in the moving direction.

The downstream end portion 261A has an outer surface Fo facing the heater 110 and an inner surface Fi facing the holder 140. The outer surface Fo is arcuate in cross section and adjacent to a downstream end of the guide surface Fg in the moving direction and a downstream end of the inner surface Fi in the moving direction.

The inner surface Fi is a flat surface orthogonal to the particular direction. The inner surface Fi is spaced in the particular direction from the rotation center X1 of the rotator 120 further than the upstream end Ep of the facing surface Fp1 of the upstream pad P1.

In this alternative embodiment, the tapering downstream end portion 261A reduces physical contact with the sliding sheet 180, thus reducing the possibility of a wearing out of the sliding sheet 180, unlike, for example, a non-tapering downstream end portion.

The sliding sheet 180 may be omitted. Even in this case, the belt 130 rarely contacts the downstream end portion 261A as the downstream end portion 216A tapers, that is, the outer surface Fo of the downstream end portion 216A extends away from the belt 130. Thus, the belt 130 is prevented from being strongly pressed against and worn by the downstream end portion 261A.

The above embodiment shows but is not limited to that the urging members SP urge the holder 140 toward the rotator 120. The urging members may urge the rotator toward the holder. The urging members SP are not limited to helical compression springs. Examples of the urging members include a helical compression spring, a leaf spring, and a torsion spring.

In the illustrative embodiment, the halogen lamp is illustrated as a heater. Examples of the heater include a carbon heater.

In the illustrative embodiment, a cylindrical roller having the heater 110 therein is illustrated as a rotator. Examples of the rotator may include a belt whose inner peripheral surface may be heated by a heater. An outer peripheral surface of the rotator may be heated by a heater disposed outside of the rotator or using an induction heating ("IH") element. A heater may be disposed within an interior space of a belt to indirectly heat the rotator contacting an outer peripheral surface of the belt. A heater may be disposed within an interior space of each of the rotator and the belt.

Each of the elements or components which have been described in the illustrative embodiment and modifications may be used in any combination.

What is claimed is:

1. A device comprising:

a rotator having a rotation axis;

a belt;

a nip forming member including an upstream pad and a downstream pad located downstream of the upstream pad in a moving direction of the belt, the upstream pad being surrounded by the belt and including a first facing surface that faces the rotator, the first facing surface having a first nipping area that, with the rotator, pinches the belt to form an upstream nip in a first state, and the downstream pad being surrounded by the belt and including a second facing surface that faces the rotator, the second facing surface having a second nipping area that, with the rotator, pinches the belt to form a downstream nip in the first state;

an urging member configured to urge one of the rotator and the nip forming member towards the other in a particular direction perpendicular to each of the rotation axis and the moving direction;

an upstream guide including an upstream guide surface configured to guide an inner peripheral surface of the belt; and a downstream guide including a downstream guide surface configured to guide the inner peripheral surface of the belt, wherein an upstream edge of the second nipping area in the moving direction is located farther from the rotation axis, in the particular direction, than a downstream edge of the first nipping area in the moving direction in a second state where the upstream nip and the downstream nip are not formed, wherein the device further comprises an upstream wall and a downstream wall, wherein the upstream wall is located between the upstream pad and the upstream guide, and contacts an upstream end of the upstream pad, and wherein the downstream wall is located between the downstream pad and the downstream guide, and contacts a downstream end of the downstream pad.

2. The device according to claim 1, wherein the upstream nip is formed by a part of the upstream pad that includes the downstream edge of the first facing surface and does not include an upstream edge of the first facing surface.

3. The device according to claim 1, wherein the downstream nip is formed by a part of the downstream pad that includes the upstream edge of the second facing surface and does not include a downstream edge of the second facing surface.

4. The device according to claim 1, wherein the device further comprises a holder configured to hold each of the upstream pad and the downstream pad.

5. The device according to claim 4, wherein the holder includes an upstream support surface configured to support the upstream pad and a downstream support surface configured to support the downstream pad, and wherein the upstream support surface and the downstream support surface are at the same positions in the particular direction.

6. The device according to claim 1, wherein the downstream pad has a higher hardness than the upstream pad.

7. The device according to claim 1, wherein each of the upstream pad and the downstream pad has a rectangular shape when viewed from a direction of the rotation axis in a state where the upstream nip and the downstream nip are not formed.

8. The device according to claim 1, wherein the downstream pad is spaced from the upstream pad in the moving direction.

9. A device comprising:

a rotator having a rotation axis;

a belt;

a nip forming member including an upstream pad and a downstream pad located downstream of the upstream pad in a moving direction of the belt, the upstream pad being surrounded by the belt and configured to, with the rotator, pinch the belt to form an upstream nip, the upstream pad including a first facing surface that faces the rotator, the downstream pad being surrounded by the belt and configured to, with the rotator, pinch the belt to form a downstream nip, the downstream pad including a second facing surface that faces the rotator;

an urging member configured to urge one of the rotator and the nip forming member towards the other in a particular direction perpendicular to each of the rotation axis and the moving direction;

an upstream guide including an upstream guide surface configured to guide an inner peripheral surface of the belt;

a downstream guide including a downstream guide surface configured to guide the inner peripheral surface of the belt;

an upstream wall located between the upstream pad and the upstream guide, and contacting an upstream end of the upstream pad; and a downstream wall located between the downstream pad and the downstream guide, and contacting a downstream end of the downstream pad, wherein the upstream nip is formed by a part of the upstream pad that includes a downstream edge of the first facing surface, and wherein the downstream nip is formed by a part of the downstream pad that includes an upstream edge of the second facing surface and does not include a downstream edge of the second facing surface.

10. The device according to claim 9, wherein the device further comprises a holder configured to hold each of the upstream pad and the downstream pad.

11. The device according to claim 10, wherein the holder includes an upstream support surface configured to support the upstream pad and a downstream support surface configured to support the downstream pad, and wherein the upstream support surface and the downstream support surface are at the same positions in the particular direction.

12. The device according to claim 9, wherein the downstream pad has a higher hardness than the upstream pad.

13. The device according to claim 9, wherein each of the upstream pad and the downstream pad has a rectangular shape when viewed from a direction of the rotation axis in a state where the upstream nip and the downstream nip are not formed.

14. The device according to claim 9, wherein a width of the upstream pad in the moving direction is greater than a width of the downstream pad in the moving direction.

15. A device comprising:

a rotator having a rotation axis;

a belt;

a nip forming member including an upstream pad and a downstream pad located downstream of the upstream pad in a moving direction of the belt, the upstream pad being surrounded by the belt and configured to, with the rotator, pinch the belt to form an upstream nip, the downstream pad being surrounded by the belt and configured to, with the rotator, pinch the belt to form a downstream nip, the nip forming member being configured to form, between the upstream nip and the downstream nip, a middle nip in which the upstream pad and the downstream pad are configured not to pinch the belt, a width of the middle nip being less than a width of the upstream nip, the width of the middle nip being greater than a width of the downstream nip;

an urging member configured to urge one of the rotator and the nip forming member towards the other in a particular direction perpendicular to each of the rotation axis and the moving direction;

an upstream guide including an upstream guide surface configured to guide an inner peripheral surface of the belt; and a downstream guide including a downstream guide surface configured to guide the inner peripheral surface of the belt.

16. The device according to claim 15, wherein the upstream pad includes a first facing surface that faces the rotator, and wherein the upstream nip is formed by a part of the upstream pad that includes a downstream edge of the first facing surface and does not include an upstream edge of the first facing surface.

17. The device according to claim 15, wherein the downstream pad includes a second facing surface that faces the rotator, and wherein the downstream nip is formed by a part of the downstream pad that includes the upstream edge of the second facing surface and does not include a downstream edge of the second facing surface.

18. The device according to claim 15, wherein the device further comprises a holder configured to hold each of the upstream pad and the downstream pad.

19. The device according to claim 18, wherein the holder includes an upstream support surface configured to support the upstream pad and a downstream support surface configured to support the downstream pad, and wherein the upstream support surface and the downstream support surface are at the same positions in the particular direction.

20. The device according to claim 15, wherein the downstream pad has a higher hardness than the upstream pad.

* * * * *